US005749582A

United States Patent [19]

Fritz et al.

[11] Patent Number: 5,749,582

[45] Date of Patent: May 12, 1998

[54] AUTOMOBILE RACING BOARD GAME

[76] Inventors: Bernard L. Fritz, 6300 Eichelberger; Bryan L. Fritz, 5847 Holly Hills, both of St. Louis, Mo. 63109

[21] Appl. No.: 681,795

[22] Filed: Jul. 29, 1996

Related U.S. Application Data

[63] Continuation-in-part of Ser. No. 588,233, Jan. 18, 1996, abandoned.

[51] Int. Cl.[6] ..... A63F 3/00

[52] U.S. Cl. ..... 273/246

[58] Field of Search ..... 273/242, 243, 273/244, 246, 259, 277

[56] References Cited

U.S. PATENT DOCUMENTS

| | | | |
|---|---|---|---|
| 1,448,201 | 3/1923 | Cornell et al. | 273/246 |
| 2,453,290 | 11/1948 | Wetzel | 273/246 |
| 2,823,919 | 2/1958 | Scruggs | 273/246 |
| 3,057,623 | 10/1962 | Barnes | 273/246 |
| 3,463,496 | 8/1969 | Weinstein et al. | 273/246 |
| 3,834,709 | 9/1974 | Lamb | 273/246 |
| 4,062,545 | 12/1977 | Witney | 273/246 X |
| 4,799,685 | 1/1989 | Hoffman, Jr. | 273/246 |
| 5,048,841 | 9/1991 | Manney et al. | 273/246 |
| 5,092,605 | 3/1992 | Hoffman | 273/246 |
| 5,114,151 | 5/1992 | Bergerstock | 273/246 |
| 5,114,152 | 5/1992 | Rouse et al. | 273/246 |
| 5,308,078 | 5/1994 | Hatter | 273/246 |
| 5,322,293 | 6/1994 | Goyette | 273/246 |
| 5,350,178 | 9/1994 | Hollar | 273/246 |

FOREIGN PATENT DOCUMENTS

| | | | |
|---|---|---|---|
| 2416033 | 10/1979 | France | 273/246 |

*Primary Examiner*—William E. Stoll

*Attorney, Agent, or Firm*—Armstrong, Teasdale, Schlafly, & Davis

[57] ABSTRACT

A method of playing a race game with a game apparatus that includes a game board having an endless loop track divided into a plurality of lanes. Each lane is divided into a plurality of spaces, the spaces being differentiated into at least card spaces and lane changes spaces. There are a plurality of action cards that direct the players to take certain actions, and a playing piece for each player. Each player takes a turn moving his or her playing piece around the spaces in a lane of the track. No player's playing piece is allowed to pass over another player's playing piece in the same lane. The player draws an action card if at the end of the turn the player's playing piece is on a card space, and the player has the option of changing lanes if at the end of the player's turn the player's playing piece is on a lane change space. Play continues until one player has traversed the track a predetermined number of times.

17 Claims, 2 Drawing Sheets

AUTOMOBILE RACING BOARD GAME

CROSS-REFERENCE TO RELATED APPLICATION

This application is a continuation-in-part of U.S. patent application Ser. No. 08/588,233, now abandoned, filed Jan. 18, 1996, the disclosure of which is incorporated herein by reference.

FIELD OF THE INVENTION

This invention relates to automobile racing games, and more particularly to an automobile racing board game.

BACKGROUND AND SUMMARY OF THE INVENTION

Auto racing is one of the most popular spectator sports in the United States, enjoying a high degree of fan interest. Various automobile racing themed games have been made which attempt to simulate the action, excitement, and strategy of automobile racing. Some of these games are simple races around a game-board track in which the winner is determined purely by luck. While such games are easy to play, they are not particularly interesting or challenging for adults, and thus are not ideal for family play. Others of these games have complicated rules to make the game more realistic and more challenging, but which also make the game too difficult for younger players, and thus not ideal for family play. U.S. Pat. Nos. 5,092,605, 5,114,151, 5,308,078, 5,322,293 and 5,350,178 are examples of the type of automobile racing themed games that have been available. What has been needed is an automobile racing game that incorporates some of the elements of racing strategy to make the game interesting and exciting for adults, but which is still relatively simple to play so that it is suitable for all members of the family.

The game of the present invention is adapted to be played on a game board having an endless loop track divided into a plurality of lanes. Each lane is in turn divided into a plurality of spaces. According to the principles of this invention, some of the spaces are designated as optional lane change spaces. According to the method of playing the game of this invention, each player takes a turn moving a playing piece around the spaces in one lane of the track. When a player's playing piece lands on one of the optional lane change spaces, the player has the option of changing lanes before ending his or her turn. No playing piece is allowed to pass over another player's playing piece in the same lane, so the option of being able to change lanes allows a player to get in front of another player and block that player or to get out from behind another player. Also, the number of spaces in each lane preferably increases toward the outside of the track, so that, as in real automobile racing, the shortest distances around the track are in the inner lanes. Play continues until one player has successfully traversed the track a predetermined number of times. The lane change option simulates realistic automobile racing strategy and prevents the game from being a mindless race around that track that would quickly bore older players, yet keeps the game simple enough that younger players can still participate.

In the preferred embodiment of the game, some of the spaces in the lanes are also designated as card spaces, and when a player's playing piece lands on one of these card spaces, the player draws a card and follows the directions on the card. The cards add other automobile racing elements to the game, such as equipment failures, pit stops, and penalties.

Thus the game of the present invention is of simple and inexpensive construction, and provides a simple, easy to play, yet interesting and challenging simulation of automobile racing. The game adds elements of strategy to the elements of chance involved in simply racing around the track, yet is still suitable for even young players. Thus the game is a perfect pastime for an entire family of automobile racing enthusiasts.

These and other features and advantages will be in part apparent, and in part pointed out hereinafter.

BRIEF DESCRIPTION OF THE PREFERRED EMBODIMENT

Figure 3A:
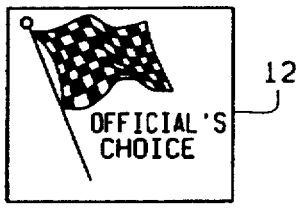
Figure 3B:
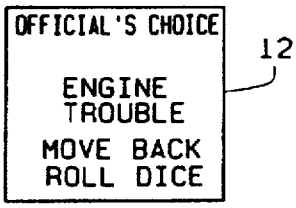
Figure 4:
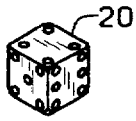
Figure 5:
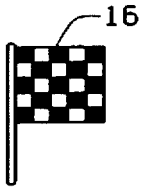
Figure 6:
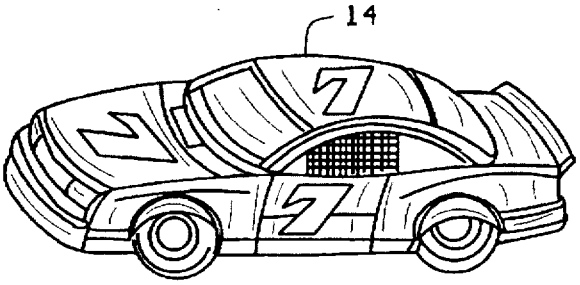

FIG. 3*a* is a view of the back side of one of the action cards;

FIG. 3*b* is a view of the front side of one of the action cards;

FIG. 4 is a perspective view of a die, which can be used to determine the number of spaces a player can move during his or her turn;

FIG. 5 is a front elevation view of one of the flags that is awarded for being the first player to successfully traverse the track the predetermined number of times;

FIG. 6 is a perspective view of a playing piece; and

Figure 7:
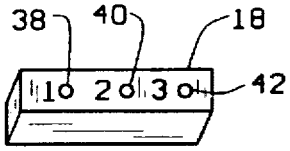

FIG. 7 is a perspective view of the flag holder for holding the flags accumulated by each player.

Corresponding reference numerals indicate corresponding parts throughout the several views of the drawings.

DETAILED DESCRIPTION OF THE DRAWINGS

The game of the present invention is played with a game apparatus shown in the Figures. The game apparatus includes a game board 10, shown in FIGS. 1 and 2, a plurality of action cards 12 shown in FIGS. 3*a* and 3*b*, a playing piece 14 for each player, as shown in FIG. 6, a collection of flags 16 (FIG. 5) and a flag holder 18 (FIG. 7) for keeping track of the number of times each player has traversed the track, as described below, and some device for determining how far each player gets to move during his or her turn, such as one or more die 20 (FIG. 4). In addition, other move indicators, such as a spinner or cards could be used to determine how far each player can move.

Figure 1:
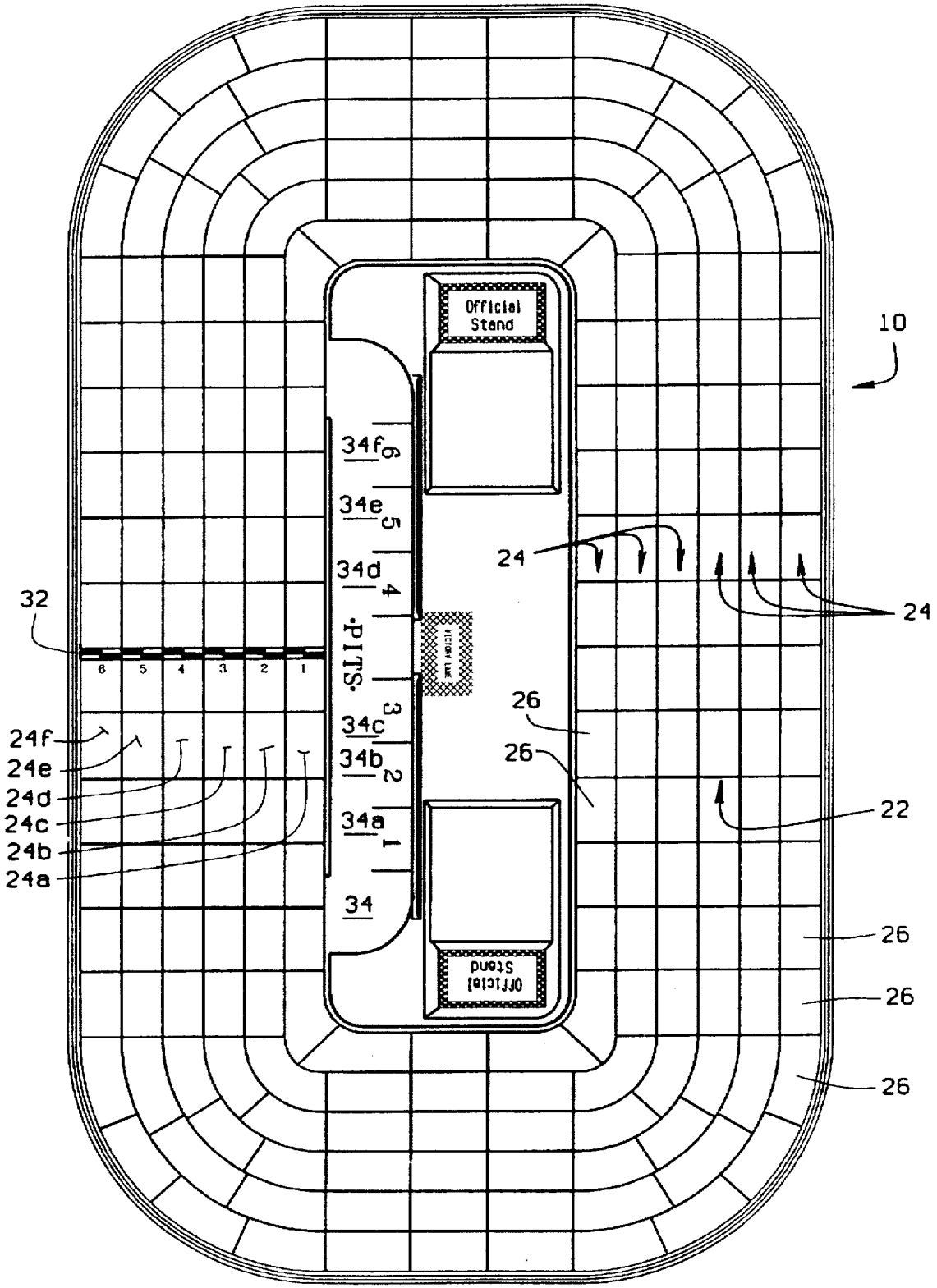
FIG. 1 is a top plan view of a game board constructed in accordance with the principles of this invention.
Figure 2:
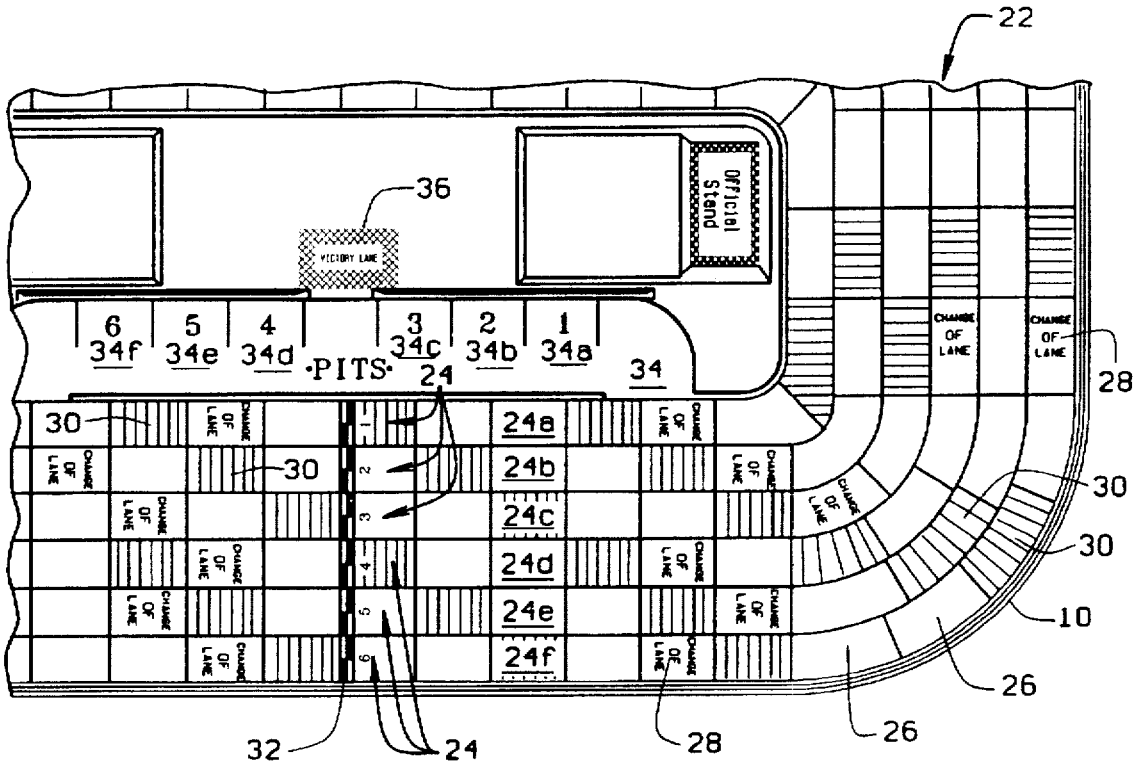
FIG. 2 is an enlarged top plan view of a portion of the game board shown in FIG. 1, showing the layout of the lane change and card spaces.

The game board 10 has an endless loop track 22 simulating an actual automobile racing track. The track 22 is divided into a plurality of lanes 24, concentrically arranged within the loop. In this preferred embodiment there are six lanes 24*a*, 24*b*, 24*c*, 24*d*, 24*e*, and 24*f*. Each of the lanes 24 is preferably divided into a number of spaces 26. The number of spaces in a given lane 24 is preferably greater than or equal to the number of spaces in the immediately adjacent inside lane, and less than or equal to the number of spaces in the immediately adjacent outside lane, so that the number of spaces generally increases from the inside lane to the outside lane. In this preferred embodiment as shown in FIG. 1, lane 24*a* has 30 spaces; lane 24*b* has 34 spaces; lane 24*c* has 38 spaces; lane 24*d* has 42 spaces; lane 24*e* has 42 spaces; and lane 24*f* has 46 spaces. Thus the distance around the track in the inner lanes is less than the distance around the track in the outer lanes.

In accordance with the principles of this invention, some of the spaces 26 are specially designated as lane change spaces 28. In this preferred embodiment some of the spaces 26 are specially designated as action card spaces 30.

The track 22 preferably also includes a start/finish line 32 by which the start and finish of a lap of the track is measured. The track 22 preferably also includes pit areas 34. There is preferably a pit area 34 for each lane 24 of the track 22, and thus in this preferred embodiment there are six pit areas 34*a*, 34*b*, 34*c*, 34*d*, 34*e*, and 34*f*. There is preferably also a victory lane space 36 where the winner goes after successfully traversing the track 22 the appropriate number of times.

As described above, the game apparatus preferably includes a plurality of action cards 12, shown in FIGS. 3*a* and 3*b*. In this preferred embodiment, the action cards are called "Official's Choice" cards (see FIG. 3*a*), and a player draws an Official's Choice card 12 each time the player lands on one of the action card spaces 30. The Official's Choice cards 12 direct the players to take further action, for example the card shown in FIG. 3*b* directs the player to move back according to the roll of the dice. Other Official's Choice cards 12 include: Out of Fuel—player must return his or her playing piece to the pit; Flat tire—player must return his or her playing piece to the pit; Black flag—player must return his or her playing piece to the pit; Change Lane—player must move his or her playing piece one lane to the right; Change Lane—player must move his or her playing piece one lane to the left; Blue flag—player must move his or her playing piece one lane to the left or right (at the player's choice); Spin Out—player must move his or her playing piece back one to six spaces (depending on the card) or lose one turn (at the player's choice); Engine Trouble—player must move playing piece back the amount of spaces determined by the dice; Do Not Change Lane—player may override another player's change lane penalty at his or her option; Drafting Pass—player may advance his or her playing piece one to six spaces (depending on the card); Bonus Card—player may eliminate any penalty at player's discretion; Pit Bonus—player may advance playing piece one to six spaces (depending on the card).

Each player has his or her own playing piece 14. As shown in FIG. 6, the playing piece 14 is preferably shaped like a race car, and more preferably like the type of race car to which the game relates. Thus, the playing piece 14 shown in FIG. 6 looks like a stock car for a stock-car racing game, but the playing piece could be made to look like some other type of race car for some other type of racing game, for example the playing pieces could be made to look like Formula One racers, or some other type of car.

The game apparatus also includes a plurality of flags 16 (FIG. 5) and flag holders 18 (FIG. 7). The flags 16 and flag holders 18 help the players keep track of the number of laps of the track that each player has made. Each time a player successfully traverses the track by crossing the start/finish line 32, the player is awarded a flag 16, which the player can conveniently mount in the flag holder 18. In this preferred embodiment, the flag holder 18 has a number one position 38 for holding flags during a player's first lap of the track 22, a number two position 40 for holding flags during a player's second lap of the track 22, and a number three position 42 for holding flags during a player's third lap of the track 22. The positions in the flag holder 18, correspond to the fact that in this preferred embodiment, a player must complete three laps to win the race. The flag 16 for completing the first lap is preferably green; the flag 16 for completing the second lap is preferably white; the flag 16 for completing the third lap in advance of the other players is preferably checkered; and the flag 16 for returning to the pit or crashing during play is preferably yellow.

Finally, the game apparatus includes some device, such as a die 20, for determining the number of spaces the player can move in his or her particular lane.

According to the method of play of the present invention, the players each select a playing piece 16, and place their playing pieces on their lane adjacent the starting line 32. The lanes can be selected by having each player roll a die, and allowing the players to select their lanes based on their rolls. For example, the player with the highest roll selects first, then the player with the next highest roll, and so on until each player has a lane assignment. The player in the inside lane 22*a* commences play and rolls the die and moves his or her playing piece the appropriate number of spaces. If a player's playing piece lands on a lane change space 28, the player has the option of changing lanes at the end of his or her turn, and before the next player's turn. If a player's playing piece lands on an action card space 30, the player picks an action card 12 and follows the directions on the card.

The players continue to take turns moving through the spaces 26 in their respective lanes 24. Each time a player successfully traverses the track, the player is awarded a flag. When a player collects a checkered flag, signifying that the player has successfully completed three laps, then the player wins the game and moves his or her playing piece to the victory lane space 36.

No player can pass another car in the same lane, and when a player rolls a number that would cause it to pass another player in the same lane, the player is blocked from moving past the space behind the space occupied by the other player, and remains in their space until their next turn. Thus there is an element of strategy to lane positioning. While there are fewer spaces in the inner lanes, and thus as a general rule a player can complete a lap on an inner lane faster than on an outer lane, these lanes will tend to be more crowded, and it is more likely that a player will be blocked by another player. The option to change lanes allows a player to move around blocks and to block others, and thus adds an element of strategy to the game that makes the game more interesting to older players, yet is still relatively simple so that younger players can play too.

OPERATION

In the method of the present invention, each player takes a turn moving a playing piece 14 around the spaces 26 in a lane 24 of the track 22. The starting positions of the playing pieces are determined by the dice 20. Each player rolls a die 20, and the player rolling the highest number places his or her playing piece 40 in the first lane 22*a*. The player rolling the next highest number places his or her playing piece on the next lane position 22*b* until all of the players have placed their playing pieces on the game board. The players then take turns rolling their die 20 and moving their respective playing pieces 14 along the spaces 26 in their respective lanes 24 in accordance with the number shown in the die 20. Play continues until one player's playing piece 14 has traversed the track 22 three times.

When in the course of play, a player lands on a change of lanes space 28, that player has the option of moving one lane inwardly or one lane outwardly. When in the course of play a player lands on an action card space 30, that player must select one of the Official's Choice cards 12, and follow the directions thereon.

Because no player's playing piece 14 is allowed to pass over another player's playing piece in the same lane, lane position is critical, and the ability to change lanes is important to moving around a blocking playing piece and to blocking an opponent's playing piece.

Each player is awarded a flag 16 when their turn commences, for each successful traversal of the track 22, for returning to the pit or crashing during any traversal of the track, and for being the first player to successfully traverse the track a predetermined number of times. The flags 16 are preferably held for each player in a flag holder 18. After each player commences his or her first traversal of the track 22, a green flag (not shown) is awarded which is placed in the number one position 38 on the flag holder 18. If the player receives a card 12 directing them to return to their pit or indicating that they have crashed, the player must replace their flag with a yellow flag (not shown). After the player's next turn, they will replace the yellow flag with the green flag. Upon completion of a player's first traversal of the racetrack 14, the player places their green flag (not shown) in the number two position 40 on the flag holder 18. If the player receives a card 12 directing them to return to their pit or indicating that they have crashed, the player must replace their green flag with a yellow flag. Upon completion of a player's second traversal of the racetrack 14, the player is awarded a white flag (not shown) which is placed in number three position 42 on the flag holder 18. If the player receives a card 12 directing them to return to their pit or indicating that they have crashed, the player must replace their white flag with a yellow flag. After the player's next turn, they will replace the yellow flag with the white flag. The first player to complete a third traversal of the racetrack 22, is awarded a checkered flag, shown in FIG. 5, which replaces the white flag in the flag holder 18, and the playing piece is placed in the victory lane space 36.

What is claimed is:

1. A method of playing a race game on a game board having an endless loop track divided into a plurality of lanes, each lane being divided into a plurality of spaces, some of the spaces being designated as lane change spaces, some of the spaces being designated as action card spaces, the loop track having a start/finish line extending across the track generally perpendicularly to the lanes, and a pit area positioned inside the loop track on the game board, the method comprising the steps of:

each player taking a turn moving a playing piece around the spaces in a lane of the track, the player having an option of changing lanes if at the end of the player's turn his or her playing piece is on a lane change space, no player's playing piece being allowed to pass over another player's playing piece in the same lane, the player drawing an action card if at the end of the player's turn his or her playing piece is on an action space, at least one action card designated as a lane change card, the player moving his or her playing piece according to the action card, the player moving his or her playing piece to a different lane when the lane change card is drawn, the player receiving a flag each time his or her playing piece crosses the start/finish line, the player removing the flag and replacing it with a yellow flag each time his or her playing piece lands on the pit area, play continuing until one player's playing piece has traversed the track a predetermined number of times.

2. The method according to claim 1 wherein the lanes are concentrically arranged on the game board, the lanes including an inner lane proximate to the center of the game board, an outer lane further away from the center of the game board than the other lanes, and a plurality of middle lanes between the inner lane and the outer lane, each of the middle lanes having an inner side, and the number of spaces in the inner lane is less than or equal to the number of spaces in any one of the middle lanes, and the number of spaces in any one of the middle lanes is greater than or equal to the number of spaces in the lane on its inner side, and the number of spaces in the outer lane is greater than or equal to the number of spaces in any one of the middle lanes.

3. The method according to claim 1 wherein the predetermined number of times is three.

4. A method of playing a race game with a game apparatus including a game board having an endless loop track divided into a plurality of lanes, each lane being divided into a plurality of spaces, the spaces being differentiated into at least card spaces and lane change spaces, the loop track having a start/finish line extending across the track generally perpendicularly to the lanes, and a pit area positioned inside the loop track on the game board; a plurality of action cards that direct the players to take certain actions, at least one action card designated as a lane change card; and a playing piece for each player; the method comprising the steps of:

each player taking a turn moving his or her playing piece around the spaces in a lane of the track, the player drawing an action card if at the end of the turn the player's playing piece is on a card space, the player moving his or her playing piece according to the action card, the player moving his or her playing piece to a different lane when the lane change card is drawn, the player having the option of changing lanes if at the end of the player's turn the player's playing piece is on a lane change space, with no player's playing piece being allowed to pass over another player's playing piece in the same lane, the player receiving a flag each time his or her playing piece crosses the start/finish line, and the player removing the flag and replacing it with a yellow flag each time his or her playing piece lands on the pit area, play continuing until one player's playing piece has traversed the track a predetermined number of times.

5. The method according to claim 4 wherein the lanes are concentrically arranged on the game board, the lanes including an inner lane proximate to the center of the game board, an outer lane further away from the center of the game board than the other lanes, and a plurality of middle lanes between the inner lane and the outer lane, each of the middle lanes having an inner side, and the number of spaces in the inner lane is less than or equal to the number of spaces in any one of the middle lanes, and the number of spaces in any one of the middle lanes is greater than or equal to the number of spaces in the lane on its inner side, and the number of spaces in the outer lane is greater than or equal to the number of spaces in any one of the middle lanes.

6. The method according to claim 4 wherein the predetermined number of times is three.

7. A method of playing a race game with a game apparatus including a game board having an endless loop track divided into a plurality of lanes, each lane being divided into a plurality of spaces, the spaces being differentiated into at least card spaces and lane changes spaces, the loop track having a start/finish line extending across the track generally perpendicularly to the lanes, and a pit area positioned inside the loop track on the game board; a plurality of action cards that direct the players to take certain actions, at least one action card designated as a lane change card; a playing piece for each player; and a move indicator for indicating the number of spaces a player can move during his or her turn, the method comprising the steps of:

each player taking a turn moving his or her playing piece around the spaces in a lane of the track according to the number indicated by the move indicator, the player drawing an action card if at the end of the turn the player's playing piece is on a card space, the player moving his or her playing piece according to the action card, the player moving his or her playing piece to a different lane if the lane change card is drawn, the player having the option of changing lanes if at the end of the player's turn the player's playing piece is on a lane change space, with no player's playing piece being allowed to pass over another player's playing piece in the same lane, the player receiving a flag each time his or her playing piece crosses the start/finish line, and the player removing the flag and replacing it with a yellow flag each time his or her playing piece lands on the pit area, play continuing until one player has traversed the track a predetermined number of times.

8. The method according to claim 7 wherein the lanes are concentrically arranged on the game board, the lanes including an inner lane proximate to the center of the game board, an outer lane further away from the center of the game board than the other lanes, and a plurality of middle lanes between the inner lane and the outer lane, each of the middle lanes having an inner side, and the number of spaces in the inner lane is less than or equal to the number of spaces in any one of the middle lanes, and the number of spaces in any one of the middle lanes is greater than or equal to the number of spaces in the lane on its inner side, and the number of spaces in the outer lane is greater than or equal to the number of spaces in any one of the middle lanes.

9. The method according to claim 7 wherein the predetermined number of times is three.

10. The method according to claim 7 wherein the game apparatus further comprises a plurality of flag holders for holding the flags.

11. A method of playing a game comprising:

providing a game board having a racetrack configuration with a plurality of lanes, the lanes having a plurality of spaces including at least two types of specially marked spaces, the racetrack having a start/finish line extending across the track generally perpendicularly to the lanes, and a pit area positioned inside the loop track on the game board; a move indicator, and a plurality of cards, at least one action card designated as a lane change card;

providing a playing piece for each player;

determining a number with the move indicator;

each player taking a turn;

moving his or her playing piece around the racetrack according to a number of spaces which corresponds to the number determined by the move indicator;

drawing a card when the playing piece lands on one type of specially marked space;

moving his or her playing piece to a different lane when the lane change card is drawn;

having the option to change lanes when the predetermined number of spaces moved results in placement of the playing piece on the other type of specially marked space;

circling around the game board a predetermined number of times until at least one player's marker has traversed the racetrack the predetermined number of times;

each player receiving a flag each time his or her playing piece crosses the start/finish line, wherein the flags are color coded to reflect the number of laps completed; and each player removing the flag and replacing it with a yellow flag each time his or her playing piece lands on the pit area.

12. The method of playing a game according to claim 11 wherein the predetermined number of times is three.

13. The method of playing a game according to claim 11 wherein the move indicator are dice.

14. The method of playing a game according to claim 11 further comprising flag holders for placing flags to indicate each circle around the racetrack by each playing piece.

15. The method of playing a game according to claim 11 wherein the one type of specially marked space is an Officials Choice space.

16. The method of playing a game according to claim 11 wherein the other type of specially marked space is a Driver's Option/Lane Change space.

17. The method of playing a game according to claim 16 wherein placement of a playing piece on the Driver's Option/Lane Change space gives the player the option to change lanes.

* * * * *